United States Patent [19]

Gilbert

[11] Patent Number: 4,943,246

[45] Date of Patent: Jul. 24, 1990

[54] ELECTRICAL CONNECTOR FOR WIRE CONNECTION

[76] Inventor: Hugh H. Gilbert, 19 Thrifts Walk, High Street Chesterton, Cambridge, United Kingdom

[21] Appl. No.: 369,727

[22] Filed: Sep. 7, 1989

Related U.S. Application Data

[63] Continuation of Ser. No. 151,477, Feb. 2, 1988, abandoned.

[30] Foreign Application Priority Data

Feb. 3, 1987 [GB] United Kingdom ..... 8702409

[51] Int. Cl.[5] ..... H01R 11/09

[52] U.S. Cl. ..... 439/656; 439/577; 439/796; 439/864

[58] Field of Search ..... 439/459, 656, 725, 888, 439/794, 863, 864, 404, 409–418, 577, 796

[56] References Cited

U.S. PATENT DOCUMENTS

| | | | |
|---|---|---|---|
| 1,666,991 | 4/1928 | Cohen | 439/864 |
| 2,097,603 | 11/1937 | Ruth | 439/657 |
| 3,139,315 | 6/1964 | Baldo | 439/409 |
| 3,417,368 | 12/1968 | Norden | 439/577 |
| 4,533,199 | 8/1985 | Feldberg | 439/404 |

FOREIGN PATENT DOCUMENTS

| | | |
|---|---|---|
| 2026784 | 2/1980 | United Kingdom . |
| 2098812 | 11/1982 | United Kingdom . |
| 2140223 | 11/1984 | United Kingdom . |

OTHER PUBLICATIONS

Published International Application No. WO 87/00977 of International Application No. PCT/Gb 86/00475 (Inventor: Hugh H. Gilbert), 2/12/1987.

*Primary Examiner*—Neil Abrams
*Attorney, Agent, or Firm*—Michael J. Striker

[57] ABSTRACT

An electrical connector in which a flexible wire is placed into electrical connections with an electrically conducting terminal means by means of a two-component wire trap, one component of which is electrically connected to the said terminal means. The two components of the wire trap define convex and concave members movable between relatively "open" and "closed" positions about a turning axis. A wire passage receiving wire fed in endwise thereof, terminates between the two components in their "open" position. Thus, when an exposed end of a wire is passed along the wire passage it is trapped between the concave and convex members as the latter move into their "closed" position, the trapped wire being bent through a right angle or approximately a right angle between the end of the wire passage and its position in the "closed" wire trap. A connector for interconnecting in pairs the wires of two 3-wire cords is disclosed.

13 Claims, 4 Drawing Sheets

ELECTRICAL CONNECTOR FOR WIRE CONNECTION

This application is a continuation of application Ser. No. 151,477, filed Feb. 2, 1988, now abandoned.

BACKGROUND OF THE INVENTION

This invention relates to an electrical connection for connecting at least one flexible wire to an electrically conducting terminal means. The invention has particular utility in respect of an electrical connector in which two or more first flexible wires are connected to, respective, two or more second flexible wires.

In a previous patent application (WO 87/00977) (hereafter referred to as "may previous application") an improvement in electrical plus, that utilizes a rotational action to effect an electrical connection between a wire and a plug pin via a two-component wire trap, has been described.

In this invention the use of a similar two-component wire trap is proposed, acting in a manner previously described, to effect electrical connection between at least one flexible wire and an electrically conducting terminal means. A connector according to this invention benefits from some or all of the advantages described in my previous application.

SUMMARY OF THE INVENTION

In its broadest aspect this invention relates to an electrical connector in which a flexible wire is placed into electrical connection with an electrically conducting terminal means by means of a two-component wire trap, one component of which is electrically connected to the said terminal means. The invention is characterized in that the two components of the wire trap define convex and concave members movable between relatively "open" and "closed" positions about a turning axis, a wire passage is provided for receiving wire fed in endwise thereof and terminating between the two components in their "open" position whereby an exposed end of a wire passed along the wire passage is trapped between the concave and convex members as the latter move into their "closed" position, the trapped wire being bent through a right angle or approximately a right angle between the end of the wire passage and its position in the "closed" wire trap.

Desirably the concave member is mounted on one part of a body of the connector and the convex member on another part of the connector, the two parts being turnably mounted to move about the turning axis which desirably extends substantially normal to the elongate direction of the wire passage.

Throughout this specification the terms "open" and "closed", when used with respect to the relative positions between two parts of the body of a connector mean that the wire traps associated with those body parts are, respectively "open" and "closed" in these specified positions and that the connector body is respectively "open" and "closed" to wire insertion into the wire traps.

Preferably at least two wire traps are provided which move together between their closed and open positions about a common turning axis. Suitably there are three wire traps one for a live wire or line wire, one for a neutral wire and one for an earth wire.

When it is desired to connect two three-core wires together, two sets of three wire traps can be disposed side-by-side, each set of three traps being independently movable together between their open and closed positions.

Preferably the sets of wire traps that make up a connector or part of a connector are movable between open and closed positions by means of a captive lid turnably mounted on a body portion of the connector. When the trap(s) is/are in the open position suitably the inlet end of the/each wire passage is exposed to receive wire and to duct a bared end thereof to a position between the concave and convex members.

Desirably a body of the connector includes means to gauge the length of each wire required for correct wiring-up of the connector. The body can also be provided with further means to strip the required length of insulation from the free end of each wire.

Suitably the body of the connector incorporates a fuse, a passage being provided in the body into which a cartridge fuse can be located when a lid thereof is in the closed position in which serves to lock the lid in its closed position.

Desirably where a plurality of wires are connected, the wire passage provided for each wire is of substantially the same length as the wire passage provided for each other wire so that each wire can be of the same length.

The body of the connector may include means to allow visual confirmation that at least one of the wires is correctly located in its wire trap.

One or more wire traps may be connected to a central spindle or other rotational device such that by rotating the spindle or equivalent device, electrical contact may be effected at a number of wire traps simultaneously. These wire traps may be electrically insulated from one another or may be electrically connected to each other. The wire traps may be in the same plane as each other or disposed along the length of the spindle so as to stack up one above, or alongside the other or others.

An instance of an application for this electrical connector requiring the connection of many wires to a remote electrical power source is to be found where a number of pieces of electrical equipment, situated in close proximity to each other, such as a stack of hi-fi equipment, require connection to a power source.

At present a bulky adaptor or adaptors is/are required to receive a plug from each appliance.

The present invention would allow insertion of bared wires, connected to each appliance, into a device containing a number of the proposed electrical connectors arranged around one or more spindles to effect rotational contact. Each bared wire would be desirably be fed into a separate wire trap and rotation of one or more spindles would effect electrical contact between the wires and the wire traps which in turn would be connected to an electrical power source via a cable and a single plug.

Due to there no longer being a necessity for accommodating bulky plugs from each appliance, such a multiconnector could be a great deal smaller than adaptors currently available and could benefit from some, or all of the advantages described in my previous application.

BRIEF DESCRIPTION OF THE DRAWINGS

Specific embodiments of the invention will now be described, by way of example, with reference to the accompanying drawings, in which.

DETAILED DESCRIPTION OF PREFERRED EMBODIMENTS

Figure 1:
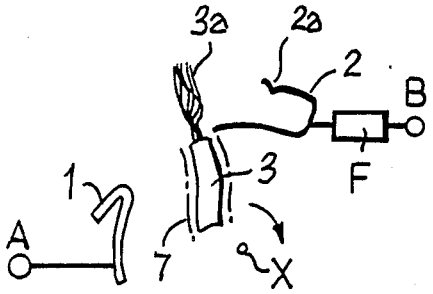
FIG. 1 shows, in plan, a wire laid across a receptor of a wire trap in an open or unconnected position.

Referring to FIG. 1, a bared end 3*a* of a wire 3 is laid across a U-shaped receptor 2. A soldered lug or terminal point B may be electrically connected to the receptor 2 in order to attach a wire, conductor or electrical component to the receptor. The bared wire 3 may be inserted endwise along a wire passage 7 (shown schematically with dash lines in FIG. 1) similar to that described in the aforementioned application.

A probe 1 is situated so that it can rotate through a quarter turn about a rotational point X in the direction of the arrow indicated. This rotational point may be a spindle to which the probe 1 is rigidly attached or it may be the center of rotation of, for instance, a disc to which the probe is attached. Alternatively the probe could be guided to move along a curved groove (not shown) of which the point X is the center of curvature.

A lug or terminal point A may be attached to the probe in order to attach a conductor or electrical component.

Figure 2:
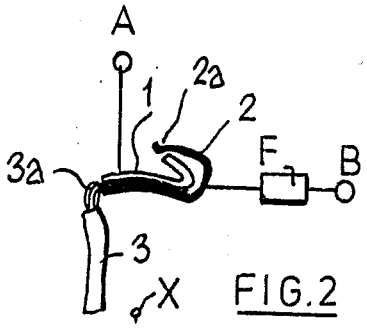
FIG. 2 shows in plan the wire trap of FIG. 1 in the closed or connected position.

Referring to FIG. 2, the probe 1 is now shown rotated through a quarter turn, in relation to FIG. 1, about the point X. The bared end 3*a* of the wire 3 has been bent through approximately 90° and is now trapped between the probe 1 and the receptor 2 and electrical contact is effected by the clamping action. The probe 1 is here shown retained by a bend 2*a* in a short leg of the receptor 2 and although this, or some similar means of retaining the probe in the receptor is desirable, it is not to be deemed to be essential.

Either the probe 1 or the receptor 2 or both must be capable of conducting electricity. Either one or both may be made of brass, copper, phosphor bronze, or electrically-conducting plastic, for instance, to ensure good electrical conductivity.

If either the probe 1 or the receptor 2 is electrically conductive then the other component of the two-component wire trap 1, 2 may be made of electrical insulating material, such as a plastics material. For instance the receptor 2 could be simply formed as a hollowed shape in a block of insulating material such as a bock of plastics or ceramic material.

Lugs or terminal points A or B may be attached to either probe 1 or receptor 2 or to both, to accept conductors from, for instance, a remote power source.

Figure 3:
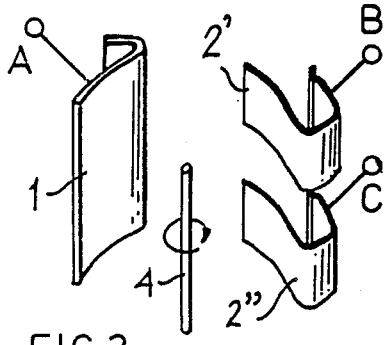
FIG. 3 shows in axonometric, in an open or unconnected position, a single probe and two receptors.

Referring to FIG. 3 a single probe 1 is shown able to rotate about a spindle 4 to effect contact with two or more receptors 2′, 2″. Terminal points A, B and C may be attached to this probe and the receptors.

Figure 4:
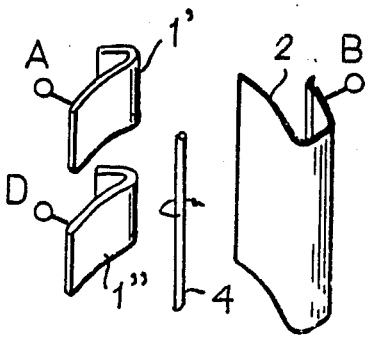
FIG. 4 shows in axonometric, in an open or unconnected position, a single receptor and two probes.

Referring to FIG. 4 a single receptor 2 may accept two or more probes 1′, 1″ by rotation about a spindle 4. Terminal points A, B and D may be attached to the receptor 2 and the probes 1′, 1″.

Figure 5:
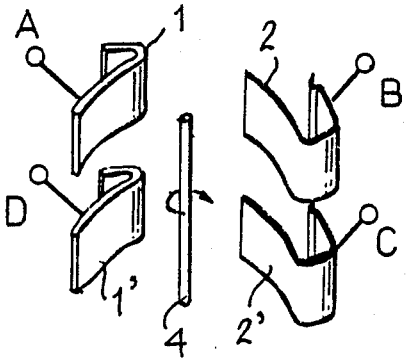
FIG. 5 shows in axonometric and in the unconnected position, two wire traps stacked one above the other able to rotate about the same spindle.
Figure 6:
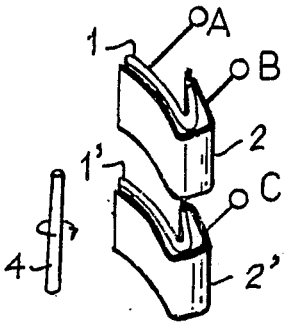
FIG. 6 shows in axonometric the arrangement of FIG. 5 in the closed or connected position.

Referring to FIG. 5 two or more wire traps 1, 2 may be stacked one above the other 1′, 2′, both of which are activated by rotation of the probes 1, 1′ simultaneously or separately, about the same central spindle 4. FIG. 6 shows the probes 1, 1′ of the wire traps after the probes have been rotated through a quarter turn in relation to FIG. 5 to meet the receptors 2, 2′. For clarity in FIG. 6, wire ends are not shown located in the wire traps.

These wire traps 1, 2 and 1′, 2′ may be electrically insulated from each other or electrically connected to each other, to double the security of connection, or to make a connection to a separate wire.

Although a 90 degree turn has been described in each of FIGS. 1 to 6 for moving the components of the wire traps between open and closed conditions this is merely one example and other turn angles are clearly possible.

The connectors illustrated can include a fuse (e.g. as shown at F in FIGS. 1 and 2), means of locking the connectors together, a cable grip, a gauge for determining the length of insulation to be stripped from a wire end and a stripping means fitted into a housing of the connector in the manner described in my previous application.

Figure 7:
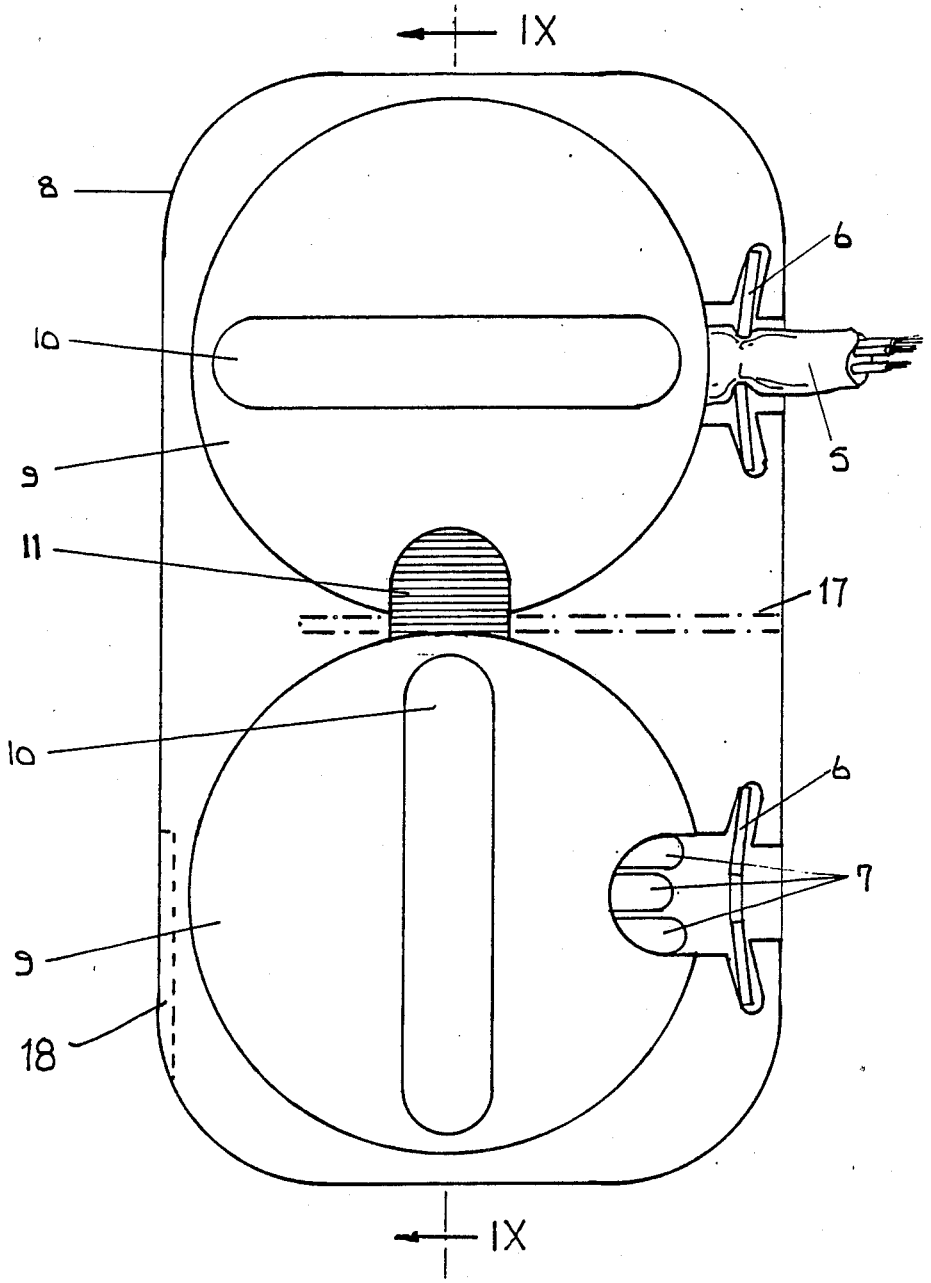
FIG. 7 shows a top plan view of one embodiment of connector designed to electrically connect two 3-wire cables together.
Figure 8:
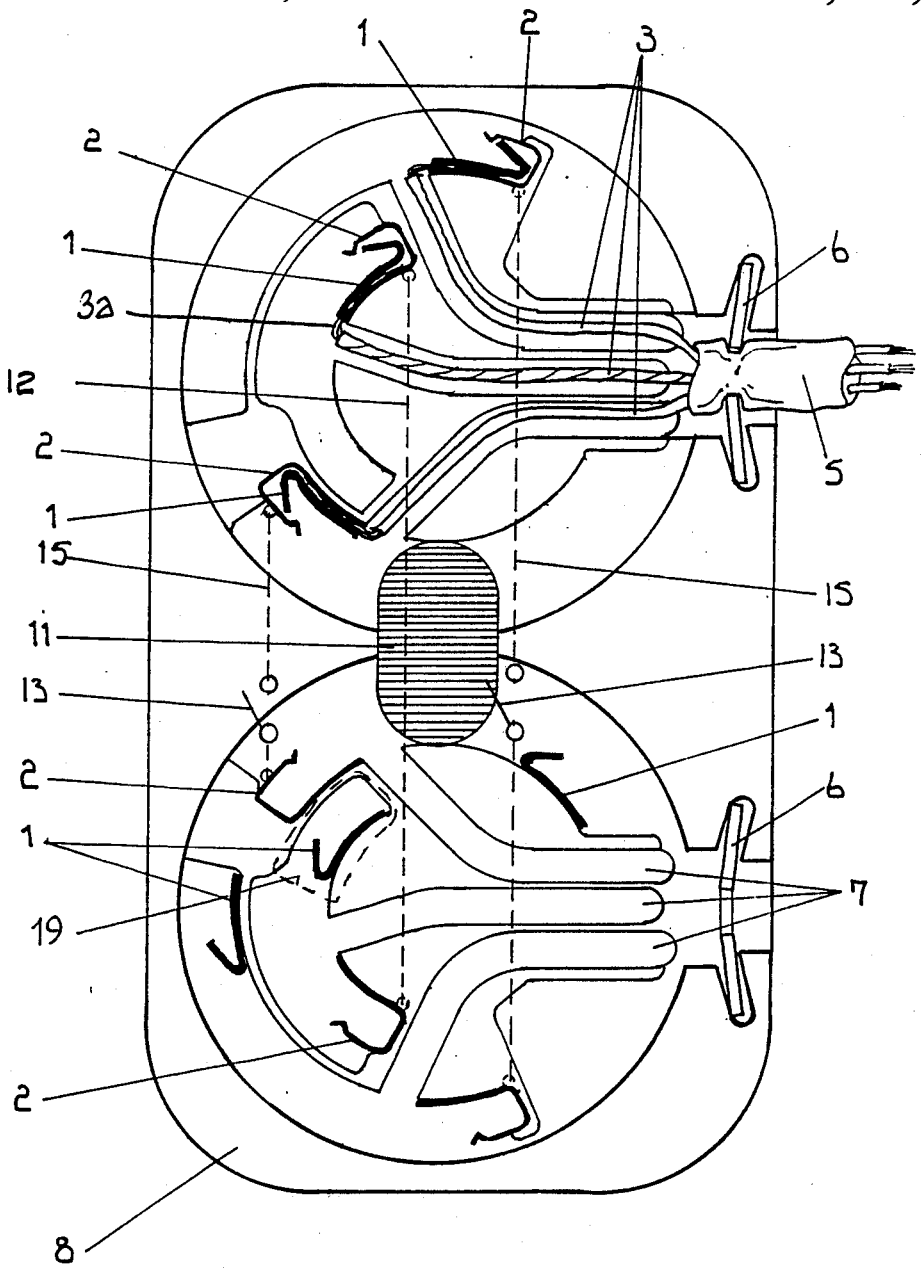
FIG. 8 is a view similar to FIG. 7 showing the lids removed.
Figure 9:
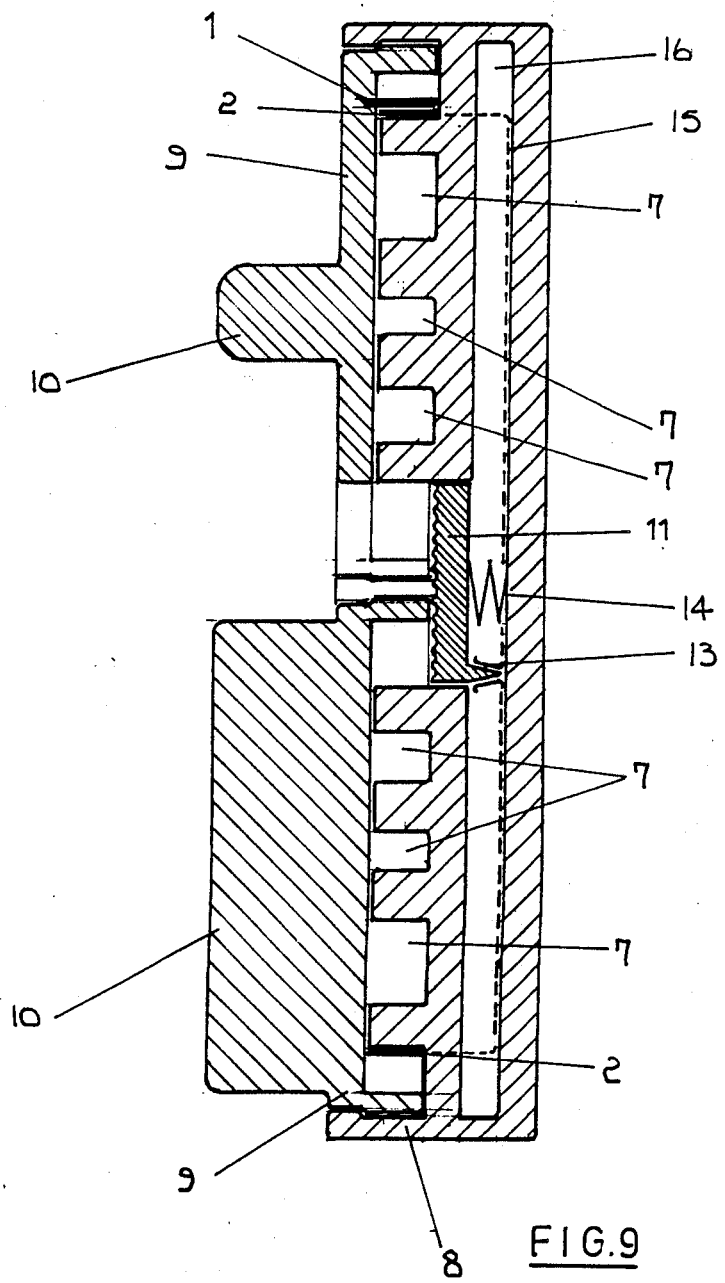
FIG. 9 shows a section on the line IX—IX of FIG. 7.

FIGS. 7 to 9 show a practical embodiment of connector according to the invention designed to connect two 3-core wires together via two sub-connectors.

The connector is based on a housing of plastics material having a body 8 and two captive lids 9 turnably mounted on the body 8. Handles 10 enable each lid to be manually turned through 90° between open and closed positions. The upper lid 19 in FIG. 7 is shown in the closed position and the lower lid 9 is shown in the open position.

FIG. 8 shows the structure below the lids 9 and the three wire traps 1, 2, three wire passages 7 and cord grip 6 of the sub-connector associated with each lid 9. The upper lid 9 has to be turned anticlockwise through 90° to move it into the open position and the lower lid 9 has to be moved anticlockwise through 90° to move it into its closed position.

Each wire 3 is independently connected and secured and a push switch 11 is located between the lids 9 to lock them in their closed positions.

The sub-connector at the bottom of each of FIGS. 7 and 8 is shown open ready for insertion of wire ends therein.

To use the connector to join respective wires 3 of two cords 5 together, the push button 11 is pushed down against a spring 14. This operates a switch 13 (which may be single pole or double pole) which in turn disconnects both connectors from each other. Having pushed down the button 11 both lids 9 are now free to rotate. The handle 10 is grasped and the lid 9 is rotated through 90° to reveal the input ends of three color-coded wire passages 7. The wires 3, with their bared ends 3*a*, are inserted endwise along the respective wire passages and the sheath of the cord 5 is pushed down into the cord grip 6. The lids 9 of both sub-connectors are then rotated through 90° (one clockwise, one anticlockwise) to close the sub-connectors and force each probe 1 into its respective receptor 2 at each wire trap thus making electrical contact. When both lids are rotated through 90° the push button 11 is allowed to spring up. This button may alternatively be a slide or rocker switch or some other form of switch. This locks both lids in place and releases the switch 13 thus connecting both sub-connectors, electrically, together via conducting strips (shown dotted) 15 running in a cavity 16 formed in the body 8. The earth conducting strip 12 remains permanently connected between the respective wire traps for the earth wires.

FIG. 9 shows a section IX—IX through the connector of FIG. 7.

A gauge (shown in chain lines at 17 in FIG. 7) can be provided for gauging the lengths of wire required for each sub-connector. A wire trimmer, gauged for length, could also be included in the body 8 and this is shown dotted at 18 in FIG. 7. The wire trimmer can be used to strip the required length of insulation from the free end of each wire 3 to leave the bared end 3*a* of the correct length.

The switch 11–14 could be replaced by a carrier for a cartridge fuse F whereby the fuse has to be removed before either lid 9 can be turned away from its closed position.

A window 19 can be provided (as shown below one of the earth traps) to show that proper connection has been made in the "on-view" trap.

What is claimed is:

1. An electrical connector which includes a two part body having one part turnable about a turning axis relative to the other part and in which an end of a length of insulation covered flexible wire is bared of insulation and brought into electrical connection with an electrically conducting terminal means in the body, said connector comprising a substantially U-shaped two component wire trap having a convex member and a concave member, one of said members being supported by one part of the body and being electrically connected to said terminal means, one of the members being mounted on one body part to move along an arcuate path about the turning axis relative to the other member mounted on the other body part, whereby the wire trap can be moved between an open position in which said members are spaced apart from each other to a closed position in which the convex member is located in the concave member, a wire passage in the body which has an open end disposed between the members in the open position of the trap, whereby the bared end of said length of wire passed along said passage protrudes from said open end across said path and is bent into said path to be trapped between the said members and thus be placed in electrical connection with said one member as the concave member surrounds the convex member in the closed position of the trap, the wire thereby being bent about the edge of one of the walls defining the U-shaped member to lie along that one wall and extend towards the base of the U-shaped member.

2. An electrical connector in which an end of a length of insulated covered wire is bared of insulation and brought into electrical connection with an electrically conducting terminal means, comprising a substantially U-shaped two component wire trap having a convex member and a concave member, one of said members being electrically connected to said terminal means, means mounting one of the members to move about a turning axis relative to the other member whereby the wire trap can be moved between an open position in which said members are spaced apart from each other to a closed position in which the convex member is located in the concave member, a wire passage which has an open end disposed between the members in the open position of the trap, whereby the bared end of said length of wire passed along said passage protrudes from said open end and is bent through at least approximately a right angle as the members of the wire trap move into their closed position and is thereby trapped between the said members and placed in electrical connection with said one member as the concave member surrounds the convex member in the closed position of the trap, the wire thereby being bent about the edge of one of the walls defining the U-shaped member to lie along that one wall and extend towards the base of the U-shaped member.

3. An electrical connector which includes a two part body having one part turnable about a turning axis relative to the other part and in which an end of a length of insulation covered flexible wire is bared of insulation and brought into electrical connection with an electrically conducting terminal means in the body, said connector comprising a two component wire trap having a convex member and a concave member having one wall and a base, one of said members being supported by one part of the body and being electrically connected to said terminal means, one of the members being mounted on one body part to move along an arcuate path about the turning axis relative to the other member mounted on the other body part, whereby the wire trap can be moved between an open position in which said members are spaced apart from each other to a closed position in which the convex member is located in the concave member, a wire passage in the body which has an open end disposed between the members in the open position of the trap, whereby the bared end of said length of wire passed along said passage protrudes from said open end across said path and is bent into said path to be trapped between the said members and thus be placed in electrical connection with said one member as the concave member surrounds the convex member in the closed position of the trap, the wire thereby being bent to lie along said one wall and at least extend toward the base of the concave member.

4. A connector as claimed in claim 3, in which the turning axis extends substantially normal to the direction of elongation of the wire passage.

5. A connector as claimed in claim 3, wherein at least two wire traps are provided in the body which move together between closed and open positions thereof about a common turning axis.

6. A connector as claimed in claim 5, wherein there are three wire traps in the body, one for a live wire, one for a neutral wire and one for an earth wire.

7. A connector as claimed in claim 3, in which two sets of plural wire traps are disposed adjacent to each other in the body, each set of wire traps being independently movable together between their open and closed positions about respective turning axes by respective turnable body parts as the respective parts of the body turn relative to a base portion of the body.

8. A connector as claimed in claim 3, wherein the two parts of said body are a captive lid turnably mounted on a base portion of the connector body.

9. A connector as claimed in claim 5, wherein when the wire trap is in the open position, the inlet end of the wire passage is exposed to receive wire and to lead a bared end thereof to a position between the concave and convex members.

10. A connector as claimed in claim 6, which includes means to gauge a length of each wire required for correct wiring-up of the connector.

11. A connector as claimed in claim 6, wherein the wire passage provided for each wire in the body is of substantially the same length as the wire passage provided for each other wire so that each wire can be of the same length.

12. A connector as claimed in claim 5, in which the body includes means to allow visual confirmation that at least one of the wires is correctly located in its wire trap.

13. An electrical connector in which an end of a length of insulated covered wire is bared of insulation and brought into electrical connection with an electrically conducting terminal means, comprising a two component wire trap having a convex member and a concave member, one of said members being electrically connected to said terminal means, means mounting one of the members to move about a turning axis relative to the other member whereby the wire trap can be moved between an open position in which said members are spaced apart from each other to a closed position in which the convex member is located in the concave member, a wire passage which has an open end disposed between the members in the open position of the trap, whereby the bared end of said length of wire passed along said passage protrudes from said open end and is bent through at least approximately a right angle to enter the trap as the members of the wire trap move into their closed position and is thereby trapped between the said members and placed in electrical connection with said one member as the concave member surrounds the convex member in the closed position of the trap.

* * * * *